United States Patent [19]

Bodenmann et al.

[11] 4,196,565

[45] Apr. 8, 1980

[54] METHOD FOR PRODUCING A JOINED CAPSULE FILLED WITH VISCOUS MATERIAL

[75] Inventors: Hans U. Bodenmann, Muenchenstein, Switzerland; Louis P. Van Herle, Berchem-Antwerp, Belgium; Luc Y. Michel, Fegersheim-Ohnheim, France; Heinrich Pins, Eberbach, Fed. Rep. of Germany; Winand H. Martens, Belsele, Belgium

[73] Assignee: S. A. Capsugel AG, Basel, Switzerland

[21] Appl. No.: 905,922

[22] Filed: May 15, 1978

[30] Foreign Application Priority Data

May 20, 1977 [DE] Fed. Rep. of Germany ..... 2722822

[51] Int. Cl.[2] ..... B65B 3/00; B65B 7/28

[52] U.S. Cl. ..... 53/471; 156/305; 206/530

[58] Field of Search ..... 53/454, 471, 472, 474, 53/485, 488, 452; 206/530; 156/305, 274

[56] References Cited

U.S. PATENT DOCUMENTS

| | | | |
|---|---|---|---|
| 1,904,012 | 4/1933 | Reichard | 53/452 X |
| 2,936,493 | 5/1960 | Scherer | 53/452 X |
| 3,847,694 | 11/1974 | Stewing | 156/305 X |

*Primary Examiner*—Travis S. McGehee

*Attorney, Agent, or Firm*—Stephn Raines; David B. Ehrlinger

[57] ABSTRACT

A method is described for joining a capsule having a body and a cap comprising the steps of telescoping the cap onto the ridge of the body part, applying a pasty solidifying sealing composition onto the inner side of the capsule in the form of a strand, in the area of the ridge.

3 Claims, 5 Drawing Figures

METHOD FOR PRODUCING A JOINED CAPSULE FILLED WITH VISCOUS MATERIAL

Figure 1:
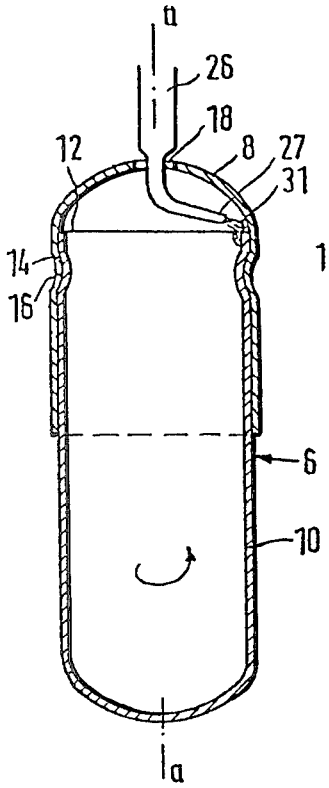

The invention relates to a method of producing of a joined capsule filled with viscous material, in particular a liquid pharmaceutical preparation, and having a body part and a cap telescoped thereon the ridge of the body part received in the cap being sealed with respect to the adjacent area of the inner side of the cap through an aperture in the joined capsule, with a pasty solidifying sealing composition being inert with respect to the viscous material, in which the joined capsule is filled with the viscous material through the aperture and the aperture is sealed subsequently in accordance with patent application No. P 27 13 873.4 in Germany which corresponds to our U.S. patent application Ser. No. 890,753 filed Mar. 27, 1978, incorporated herewith by reference. In the embodiments of the named method described as example in the patent application No. P 27 13 873.4, the entire interior of the cap is filled with the sealing composition between the closed end of the cap and the area of the ridge of the body part received in the cap. Thereby, on the one hand a considerable amount of sealing composition is consumed and on the other hand volume is lost into which the viscous material, in particular the liquid pharmaceutical composition could be filled.

The invention is based on the problem of developing the method of the kind described hereinabove in such a manner that while being operable in a simple manner a minimum of sealing composition is required.

This problem is solved according to the invention in that the sealing material is applied onto the inner side of the joined capsule in the form of a strand, in the area of the ridge of the body part.

In the process according to the invention, in which the sealing of the joined capsule is effected in the area between the body part and the cap, preferably prior to introducing the viscous material, a strand of the sealing composition is applied merely onto the marginal area between the body part and the cap. The said strand engages across the area between the ridge of the body part and the inner side of the cap, due to the initial, flowable consistency of the sealing composition, and reliably seals said area after setting. The consumption of sealing composition is thus little. The entire inner volume of the joined capsule is available to fill in the viscous material.

In accordance with a modified embodiment of the method described hereinbefore, the sealing composition is sprayed in accordance with the invention onto the inner side of the joined capsule, in the area of the ridge of the body part. The sealing composition has first a consistency allowing spraying thereof and solidifies then whereby it seals the area between the ridge of the body part and the inner side of the cap.

Advantageously the aperture through which the sealing material is introduced is formed in the closed end of the cap, and the joined capsule is oriented in upward direction with the cap when the sealing composition is introduced. With this it is achieved that the sealing composition flows alongside the inner side of the cap downwardly and penetrates into an eventually present gap between the ridge of the body part and the inner side of the cap.

In accordance with a modified embodiment of the illustrated processes, the sealing composition is applied onto the inner side of the cap and body part and cap are telescoped into their end position after the sealing composition was introduced. This embodiment of the process provides for a particularly safe sealing between body part and cap since when cap and body part are telescopically joined the ridge of the body part moves along an area of the inner side of the cap to which area sealing composition has been applied already, and hence the sealing composition creeps from this area of the inner side of the cap upto the ridge of the body part and provides for a reliable seal.

The inner volume of the joined capsule being sealed between body part and cap can be changed by the position of the area of the inner side of the cap, to which area the sealing composition is applied, and by the extent of telescopic engagement of body part and cap, and can thus be adjusted to the respective requirements.

The joined capsules usable for the method according to the invention, the sealing compositions and viscous materials are the same as those explained in patent application No. P 27 13 873.4, and are not described again to avoid repetitions.

Figure 2:
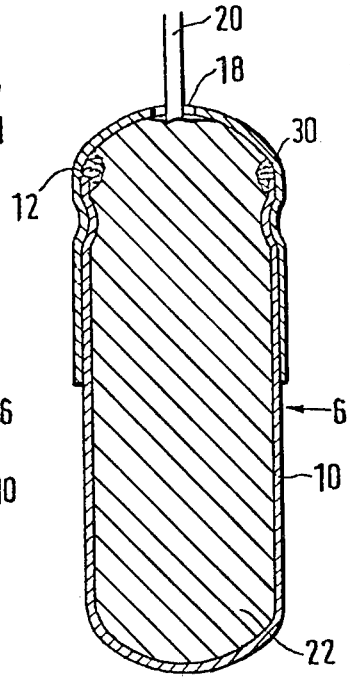
Figure 3:
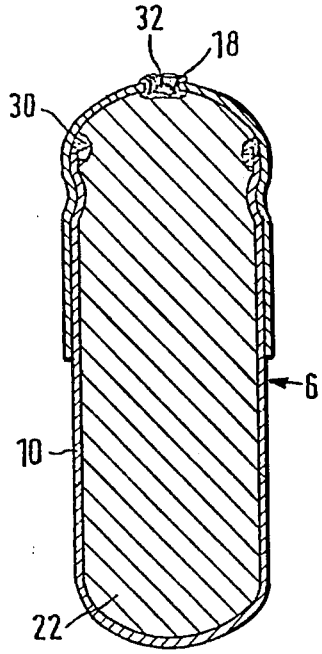
Figure 4:
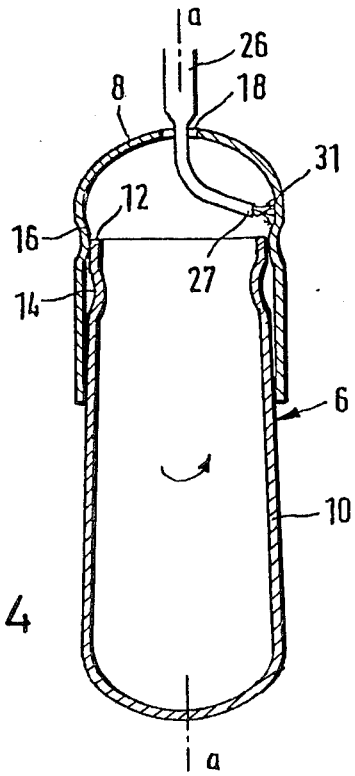

Embodiments of the invention will now be described in more detail with reference to schematic drawings, in which are shown in FIGS. 1 to 3 various method steps in the production of a joined capsule filled with liquid pharmaceutical preparation;

FIG. 4 a method step of a modified embodiment of the method; and

Figure 5:
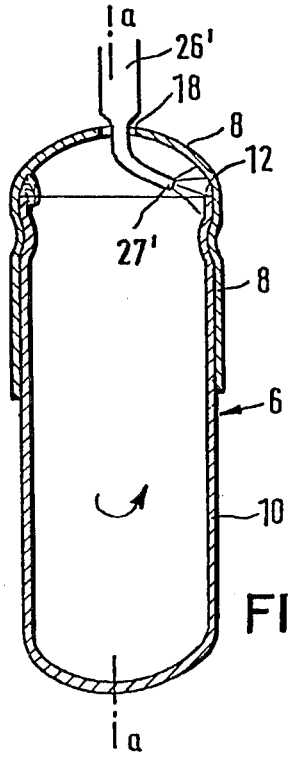

FIG. 5 a method step of an embodiment of the method modified again.

FIG. 1 shows a joined capsule 6 having a cap 8 and a body part 10. The body part 10 is formed in the proximity of its upper edge or its ridge 12 with a groove 14 into which engages a corresponding groove 16 of the cap 8 such that the cap 8 and the body part 10 are in fixed mechanical engagement. An aperture 18 is formed in the closed end of the cap 8, for instance by a drilling or piercing operation.

A hollow needle 26 bent at its end is introduced into the aperture 18 in such a manner that an outlet opening 27 of the hollow needle 26 is closely adjacent to the inner side of the cap 8, in the area of the ridge 12 of the body part 10. The joined capsule which is oriented approximately vertically while the aperture 18 points in upward direction, is then slowly rotated about its own axis a-a, and from the outlet opening 27 of the hollow needle 26 of a strand 31 of the pasty sealing composition is extruded which is deposited on the transition area between ridge 12 and the inner side of the cap 8.

After the joined capsule 6 has performed one or more rotation(s), the hollow needle 26 is moved upwardly out of the aperture 18. Cap 8 and body part 6 are sealed with a bead 30 of the sealing composition disposed annularly across the area of the ridge 12 of the body part 10.

Subsequently a hollow needle 20 is introduced into the aperture 18 such that an intermediate space remains, by means of which the joined capsule 6 is filled with liquid pharmaceutical preparation 22 to a level directly below the aperture 18. The hollow needle 20 is then moved out of the aperture 18 and sealing composition is applied onto the aperture, if required, while slightly compressing the joined capsule 6 radially thereby causing the liquid pharmaceutical preparation 22 to rise to a level directly to the aperture 18, and the interior of the joined capsule to be completely free from air. This sealing composition is drawn into the aperture 18 after the joined capsule 6 has been released from the radial pressure and forms a plug 32 which is in positive engagement with the rim of the aperture 18 and reliably seals the joined capsule being completely filled with liquid pharmaceutical preparation 22.

FIG. 4 shows an embodiment of the process in which the body part 10 is first moved not up to its end position into the cap 8, but the ridge 12 of the body part engages the groove 16 of the cap 8. In this condition of the joined capsule, the hollow needle 26 is introduced into the cap 8 through aperture 18, as illustrated in FIG. 1, and, while the joined capsule 6 is slowly rotated, a strand 31 is applied from the outlet opening 27 of the hollow needle 26 onto the inner side of the cap 8 directly above the groove 16. After the joined capsule has performed one or more rotation(s) the hollow needle 26 is moved out of the cap and the body part 10 is then fully telescoped into the cap 8. Thereby the ridge 12 of body part 10 smears the bead formed by the extrusion of the strand 31 of sealing composition to the inner side of the cap 8, while said sealing composition moves additionally over the ridge 12 of the body part such that the body part is reliably sealed with respect to the cap 8 after the sealing composition has solidified. The design of the body part 10 and of the cap 8 with grooves 14 and 16 respectively, which is an optional feature of particular advantage in this embodiment of the method, since the outer side of the ridge 12 of the body part 10 engages the inner side of the cap 8 only when the two grooves 14 and 16 are in locking engagement, whereby the bead of sealing composition is pressed from the outer side of the ridge 12 onto the inner side of the cap 8.

In the embodiment of the method according to FIG. 5 a hollow needle 26' is introduced through the aperture 18 of the cap 8, whose outlet opening 27' is designed as spray nozzle. The sealing composition is sprayed onto the inner side of the joined capsule in the area of the ridge 12 of the body part 10, while the joined capsule is slowly rotated. The sealing composition is in this case relatively thinly liquid at first and, before it solidifies, flows at the inner side of the cap 8 into a gap present possibly between ridge 12 and the inner side of the cap.

The method steps illustrated in FIGS. 4 and 5 are followed by the step of filling the joined capsule as illustrated in FIGS. 2 and 3.

We claim:

1. A method of producing a joined capsule filled with a viscous material, the capsule comprising a body part having an open end ridge and a cap having an open end adapted for mounting on to said open end of the body part, the steps comprising:
   a. Applying a pasty solidifying sealing composition, which is inert with respect to the viscous material, in a form of a strand in the inner side of the joined capsule, in the area of the ridge of the body part;
   b. Filling the capsule with said viscous material through an aperture of said cap, and
   c. Sealing the aperture in said cap.

2. The method according to claim 1, in which said sealing composition is sprayed onto said inner side of the joined capsule in the area of the ridge of the body part.

3. The method according to claim 1, in which the cap is moved in an upward direction to interlock the cap with the body part after the introduction of the sealing composition.

* * * * *